US007591345B1

(12) United States Patent
Goplen et al.

(10) Patent No.: US 7,591,345 B1
(45) Date of Patent: Sep. 22, 2009

(54) ANGLED MUFFLER SEAM CONSTRUCTION AND METHOD

(75) Inventors: Gary D. Goplen, Stoughton, WI (US); Ananth Kuchimanchi, Stoughton, WI (US)

(73) Assignee: Cummins Filtration IP Inc., Minneapolis, MN (US)

( * ) Notice: Subject to any disclaimer, the term of this patent is extended or adjusted under 35 U.S.C. 154(b) by 74 days.

(21) Appl. No.: 11/934,883

(22) Filed: Nov. 5, 2007

(51) Int. Cl.

| | |
|---|---|
| ***F01N 7/18*** | (2006.01) |
| ***B21D 51/24*** | (2006.01) |
| ***B21D 51/28*** | (2006.01) |
| ***B21D 51/30*** | (2006.01) |
| ***B21D 51/32*** | (2006.01) |
| ***B21D 51/34*** | (2006.01) |
| *F01N 1/00* | (2006.01) |
| *F01N 1/08* | (2006.01) |
| *B21D 51/16* | (2006.01) |

(52) U.S. Cl. ..... 181/272; 181/282; 29/890.08; 413/4

(58) Field of Classification Search ..... 181/272, 181/269, 268, 275, 282; 29/890.08; 413/4, 413/6

See application file for complete search history.

(56) References Cited

U.S. PATENT DOCUMENTS 670,720 A * 3/1901 Mungiven ..... 220/618
1,478,782 A * 12/1923 Dewey et al. ..... 220/614
3,169,678 A * 2/1965 Wilkinson ..... 222/478
3,921,754 A * 11/1975 Hess ..... 181/212
3,987,927 A * 10/1976 Serr et al. ..... 220/614
4,055,133 A * 10/1977 Wessely ..... 413/6
4,775,071 A * 10/1988 Giggard ..... 220/619
4,784,282 A * 11/1988 Le Bret et al. ..... 220/619
5,054,265 A * 10/1991 Perigo et al. ..... 53/425
5,143,504 A * 9/1992 Braakman ..... 413/6
6,076,632 A 6/2000 Schumacher et al.
6,250,422 B1 6/2001 Goplen et al.
6,446,322 B1 * 9/2002 Church ..... 29/513
6,457,553 B1 10/2002 Goplen et al.
6,575,267 B1 * 6/2003 Stiles et al. ..... 181/282

* cited by examiner

*Primary Examiner*—Edgardo San Martin
(74) *Attorney, Agent, or Firm*—Andrus, Sceales, Starke & Sawall, LLP; J. Bruce Schelkopf

(57) ABSTRACT

A muffler with enhanced seam strength construction, and method therefor, is provided by shell sidewalls having facing lips extending at an angled direction relative to afterfire explosive force along a lateral direction, such that outward lateral movement of the first sidewall is blocked by the second lip in the path of lateral movement of the first lip and such that outward lateral movement of the second sidewall is blocked by the first lip in the path of lateral movement of the second lip.

4 Claims, 2 Drawing Sheets

FIG. 3
PRIOR ART
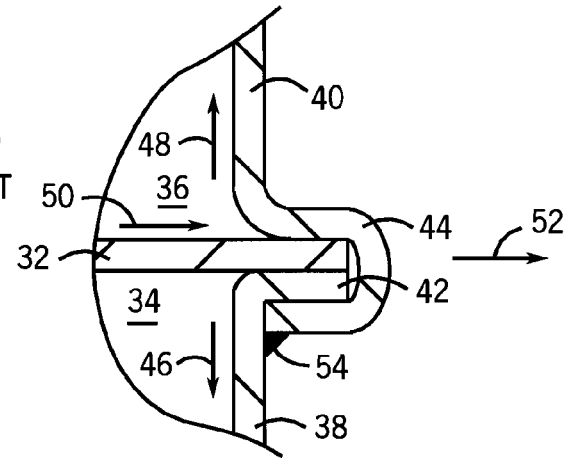
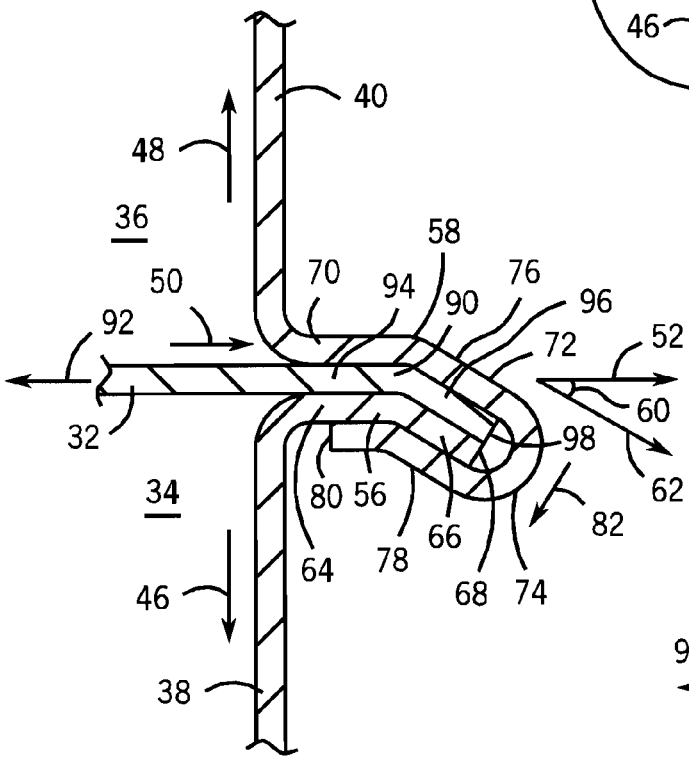
FIG. 4
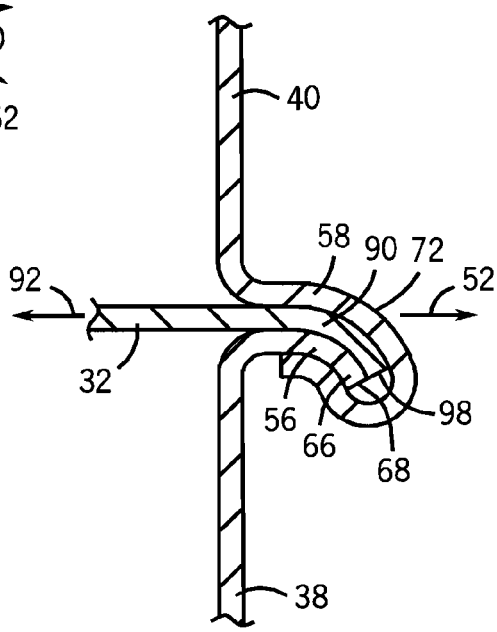
FIG. 5

ANGLED MUFFLER SEAM CONSTRUCTION AND METHOD

BACKGROUND AND SUMMARY

The invention relates to mufflers for noise-silencing.

The invention arose during continuing development efforts directed toward mufflers such as shown in U.S. Pat. Nos. 6,076,632, 6,250,422, 6,457,553, all incorporated herein by reference. The invention also arose during continuing development efforts directed toward cost reduction.

Mufflers for internal combustion engines, particularly small engines, e.g. for lawnmowers, tractors, and the like, are typically made with two shells or stampings that together comprise the outer shell of the muffler. The shells are joined together in a crimping operation. This process has been reliable and efficient, resulting in a low cost muffler. One problem which may be encountered is that many small engines exhibit an afterfire condition upon engine shutdown. This happens when unburned fuel is ignited by hot internal muffler surfaces causing an explosion in the muffler. This afterfire explosive force in the muffler can rupture the muffler at the seam of the two shells. Countermeasures for afterfire survival typically include making the muffler shells thicker or adding tack welds to the seam joint to keep the joint from separating during an afterfire. Both of these solutions may add objectionable cost.

The present invention provides a simple and effective solution to the noted afterfire problem, in a cost-effective manner.

BRIEF DESCRIPTION OF THE DRAWINGS

FIG. 3 is a sectional view taken along line 3-3 of FIG. 1.

FIG. 4 is like FIG. 3 and illustrates the present invention.

FIG. 5 is like FIG. 4 and shows a further embodiment.

DETAILED DESCRIPTION

Figure 1:
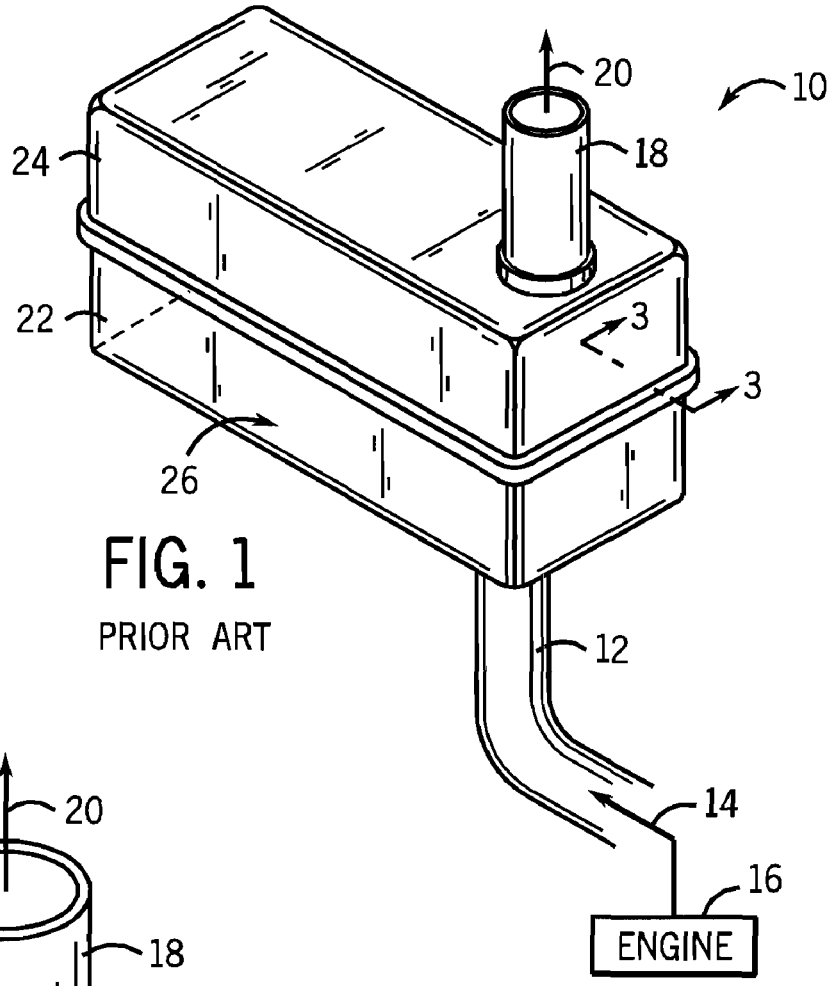
FIG. 1 PRIOR ART
FIG. 1 is an isometric elevational view of a muffler known in the prior art.
Figure 2:
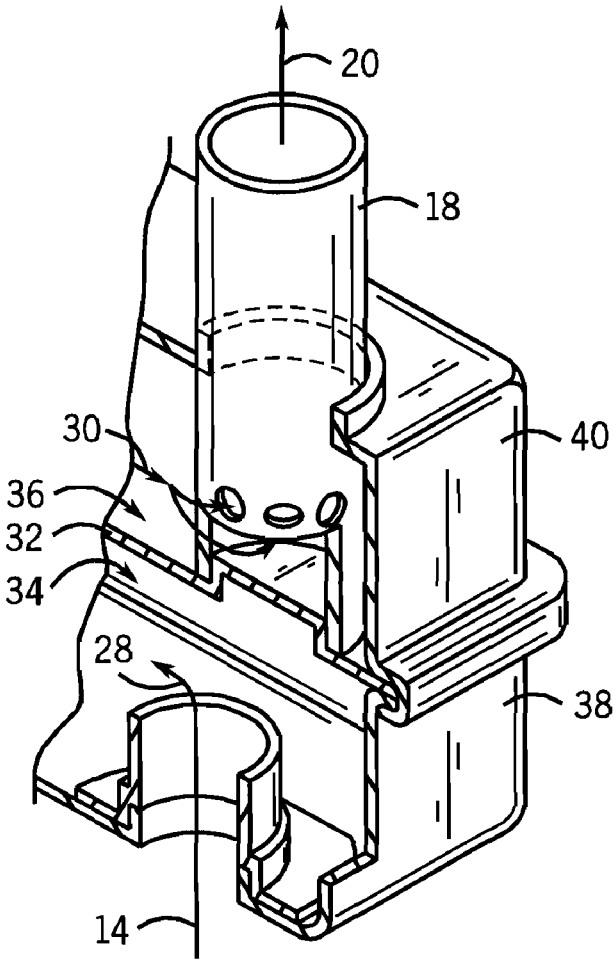
FIG. 2 PRIOR ART
FIG. 2 is a view of a portion of FIG. 1 partially cutaway.

FIGS. 1-3 show a muffler 10 known in the prior art. The muffler has an inlet 12 receiving exhaust as shown at arrow 14 from internal combustion engine 16, and has an outlet 18 discharging the exhaust as shown at arrow 20. The muffler is formed by first and second shells or stampings 22 and 24 defining an enclosure 26. Incoming exhaust at 14 is routed as shown at arrow 28 into the enclosure which may include various expansion chambers, baffling chambers, etc. for noise reduction, and then the exhaust is directed as shown at arrow 30 to outlet 18. The muffler may have one or more dividing walls such as 32 in the enclosure and defining sub-chambers therein, e.g. at 34, 36, etc.

The enclosure has respective first and second sidewalls 38 and 40 along the perimeter thereof, which sidewalls have respective first and second facing lips 42 and 44, FIG. 3. Sidewall 38 extends axially in a first axial direction 46 from first lip 42. Second sidewall 40 extends axially in a second axial direction 48 from second lip 44. Second axial direction 48 is opposite to first axial direction 46. First lip 42 extends away from first sidewall 38. Second lip 44 extends away from second sidewall 40 then around first lip 42 and then toward first sidewall 38. First and second sidewalls 38 and 40 are subject to a lateral force 50 thereon due to afterfire explosive force in the muffler. The lateral force at 50 acts to push sidewalls 38 and 40 laterally outwardly (rightwardly in FIG. 3) along a first lateral direction 52. It is known in the prior art to provide improved seam strength between the muffler shells by tack welding sidewall 38 to the turned back end of lip 44 of sidewall 40, as shown at tack weld 54. In various embodiments, there may be multiple dividing walls 32, or no dividing wall 32.

FIGS. 4 and 5 illustrate the present invention and use like reference numerals from above where appropriate to facilitate understanding.

In FIG. 4, sidewalls 38 and 40 have respective first and second facing lips 56 and 58. First sidewall 38 extends axially in the noted first axial direction 46 from first lip 56. Second sidewall 40 extends axially in the noted second axial direction 48 from second lip 58. First lip 56 extends away from first sidewall 38. Second lip 58 extends away from second sidewall 40 then around first lip 56 then toward first sidewall 38. First and second sidewalls 38 and 40 are subject to the noted lateral force 50 thereon due to afterfire explosive force in the muffler. The lateral force acts to push the sidewalls laterally outwardly along the noted first lateral direction 52. In FIG. 4, lips 56 and 58 extend at an angle 60 along an angled direction 62 relative to the noted lateral direction 52 such that outward lateral movement of first sidewall 38 is blocked by second lip 58 in the path of lateral movement of first lip 56 and such that outward lateral movement of second sidewall 40 is blocked by first lip 56 in the path of lateral movement of second lip 58.

First lip 56 has an inner portion 64 extending laterally outwardly along the noted first lateral direction 52 from first sidewall 38, and an outer portion 66 extending from inner portion 64 to an outer end 68. The noted first lateral direction 52 is perpendicular to the noted first and second axial directions 46 and 48. Second lip 58 has an inner portion 70 adjacent and extending laterally outwardly along the noted first lateral direction 52 from second sidewall 40, and an outer portion 72 having a U-shape including a bight 74 and first and second legs 76 and 78. First leg 76 extends from inner portion 70 of second lip 58 to bight 74. Bight 74 extends along outer end 68 of outer portion 66 of first lip 56. Second leg 78 extends from bight 74 to an outer end 80. Outer portion 66 of first lip 56 is between first and second legs 76 and 78 and extends at an oblique angle relative to each of the noted first lateral direction 52 and first and second axial directions 46 and 48. First and second legs 76 and 78 and outer portion 66 of first lip 56 extend parallel to each other along the noted oblique angle along direction 62. Bight 74 extends along a direction 82 which is along a second oblique angle relative to each of the first lateral direction 52 and first and second axial directions 46 and 48. The noted first and second oblique angles are perpendicular to each other. In FIG. 4, the outer portions 66 and 72 of the first and second lips 56 and 58 extend rectilinearly, e.g. along direction 62. In FIG. 5, the outer portions 66 and 72 of first and second lips 56 and 58 extend curvilinearly.

A dividing wall 32 may be present in the enclosure and defines sub-chambers such as 34 and 36 therein. In other embodiments, plural dividing walls may be provided, for example FIG. 3 of incorporated U.S. Pat. No. 6,250,422. In other embodiments, no dividing wall is present. When a dividing is present, it is preferred that the dividing wall such as 32 have a third lip 90 disposed in sandwich relation between first and second lips 56 and 58. Dividing wall 32 extends in a second lateral direction 92 from third lip 90. Second lateral direction 92 is opposite to first lateral direction 52. Third lip 90 has an inner portion 94 adjacent and extending laterally outwardly along first lateral direction 52 from dividing wall 32, and an outer portion 96 extending from inner portion 94 of third lip 90 to an outer end 98 and extending at oblique angle 60 relative to each of the first and second lateral directions 52 and 92. Bight 74 of outer portion 72 of second lip 58 extends along outer end 98 of third lip 90 and outer end 68 of first lip 56. Outer portion 66 of first lip 56 and outer portion 96 of third lip 90 are between first and second legs 76 and 78 and extend at an oblique angle relative to each of first and second lateral directions 52 and 92 and first and second axial directions 46 and 48.

The present system provides a method for enhancing seam strength of a muffler, the method comprising bending lips 56 and 58 at an angle 60 along an angled direction 62 relative to lateral direction 52 such that outward lateral movement of first sidewall 38 is blocked by second lip 58 in the path of lateral movement (rightwardly in FIGS. 4, 5) of first lip 56, and such that outward lateral movement (rightwardly in FIGS. 4, 5) of second sidewall 40 is blocked by first lip 56 in the path of lateral movement of second lip 58. The method includes bending the first and second legs 76 and 78 of the U-shaped outer portion 72 of lip 58 at an oblique angle relative to each of first lateral direction 52 and first and second axial directions 46 and 48. Legs 76 and 78 and outer portion 66 of first lip 56 are bent to extend parallel to each other along the noted oblique angle along direction 62. In one embodiment, legs 76 and 78 and outer portion 66 of first lip 56 are bent to extend rectilinearly, FIG. 4. In another embodiment, first and second legs 76 and 78 and outer portion 66 of first lip 56 are bent to extend curvilinearly, FIG. 5. The method further includes, when one or more dividing walls 32 are present, bending the outer portion 96 of third lip 90 at an oblique angle relative to each of the first and second lateral directions 52 and 92 and the first and second axial directions 46 and 48. The method includes bending first and second legs 76 and 78, with lips 56 and 90 therebetween, at the noted oblique angle relative to each of first and second lateral directions 52 and 92 and first and second axial directions 46 and 48. The system further enables a method of assembling the first and second shells 22 and 24 at the noted first and second lips 56 and 58 of the first and second sidewalls 38 and 40 without tack welding to otherwise withstand the lateral force 50 due to afterfire explosive force in the muffler, whereby to eliminate a welding step.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. A muffler with enhanced seam strength construction comprising first and second shells defining an enclosure and having respective first and second sidewalls having respective first and second facing lips, said first sidewall extending axially in a first axial direction from said first lip, said second sidewall extending axially in a second axial direction from said second lip, said second axial direction being opposite to said first axial direction, said first lip extending away from said first sidewall, said second lip extending away from said second sidewall then around said first lip then toward said first sidewall, said first and second sidewalls being subject to a lateral force thereon due to afterfire explosive force in said muffler, said lateral force acting to push said sidewalls laterally outwardly along a first lateral direction, said lips extending at an angle along an angled direction relative to said first lateral direction such that outward lateral movement of said first sidewall is blocked by said second lip in the path of lateral movement of said first lip and such that outward lateral movement of said second sidewall is blocked by said first lip in the path of lateral movement of said second lip, and a dividing wall in said enclosure and defining sub-chambers therein, said dividing wall having a third lip disposed in sandwich relation between said first and second lips, said dividing wall extending in a second lateral direction from said third lip, said second lateral direction being opposite to said first lateral direction, said third lip having an inner portion adjacent and extending laterally outwardly along said first lateral direction from said dividing wall, and an outer portion extending from said inner portion of said third lip to an outer end and extending at an oblique angle relative to each of said first and second lateral directions and said first and second axial directions.

2. The muffler according to claim 1 wherein said first lip has an inner portion adjacent and extending laterally outwardly along said first lateral direction from said first sidewall, and an outer portion extending from said inner portion of said first lip to an outer end, said second lip has an inner portion adjacent and extending laterally outwardly along said first lateral direction from said second sidewall, and an outer portion having a U-shape comprising a bight and first and second legs, said first leg extending from said inner portion of said second lip to said bight, said bight extending along said outer end of said outer portion of said first lip and said outer end of said outer portion of said third lip, said second leg extending from said bight to an outer end, wherein said outer portion of said first lip and said outer portion of said third lip are between said first and second legs and extend at an oblique angle relative to each of said first and second lateral directions and said first and second axial directions.

3. A method for enhancing seam strength of a muffler having first and second shells defining an enclosure and having respective first and second sidewalls having respective first and second facing lips, said first sidewall extending axially in a first axial direction from said first lip, said second sidewall extending axially in a second axial direction from said second lip, said second axial direction being opposite to said first axial direction, said first lip extending away from said first sidewall, said second lip extending away from said second sidewall then around said first lip then toward said first sidewall, said first and second sidewalls being subject to a lateral force thereon due to afterfire explosive force in said muffler, said lateral force acting to push said sidewalls laterally outwardly along a first lateral direction, said method comprising bending said lips at an angle along an angled direction relative to said first lateral direction such that outward lateral movement of said first sidewall is blocked by said second lip in the path of lateral movement of said first lip and such that outward lateral movement of said second sidewall is blocked by said first lip in the path of lateral movement of said second lip, wherein said muffler includes a dividing wall in said enclosure and defining sub-chambers therein, said dividing wall having a third lip disposed in sandwich relation between said first and second lips, said dividing wall extending in a second lateral direction from said third lip, said second lateral direction being opposite to said first lateral direction, said third lip having an inner portion adjacent and extending laterally outwardly along said first lateral direction from said dividing wall, and an outer portion extending from said inner portion of said third lip to an outer end, said method comprising bending said outer portion of said third lip at an oblique angle relative to each of said first and second lateral directions and said first and second axial directions.

4. The method according to claim 3 wherein said first lip has an inner portion adjacent and extending laterally outwardly along said first lateral direction from said first sidewall, and an outer portion extending from said inner portion of said first lip to an outer end, said first and second lateral directions being perpendicular to said first and second axial directions, said second lip has an inner portion adjacent and extending laterally outwardly along said first lateral direction from said second sidewall, and an outer portion having a U-shape comprising a bight and first and second legs, said first leg extending from said inner portion of said second lip to said bight, said bight extending along said outer end of said outer portion of said first lip and said outer end of said outer portion of said third lip, said second leg extending from said bight to an outer end, wherein said outer portion of said first lip and said outer portion of said third lip are between said first and second legs, said method comprising bending said first and second legs at said oblique angle relative to each of said first and second lateral directions and said first and second axial directions.

* * * * *